United States Patent [19]

Mencacci

[11] 3,951,186

[45] Apr. 20, 1976

[54] GAS FLUSHING SYSTEM FOR BEVERAGE FILLER

[75] Inventor: Samuel A. Mencacci, Saratoga, Calif.

[73] Assignee: FMC Corporation, San Jose, Calif.

[22] Filed: May 17, 1974

[21] Appl. No.: 471,093

[52] U.S. Cl. ..... 141/5; 141/11; 141/49; 141/64; 141/70

[51] Int. Cl.[2] ..... B65B 31/00

[58] Field of Search ..... 141/4–8, 141/11, 46–49, 63, 64, 69, 70, 90, 91, 92, 144–148, 260, 263, 285, 295, 367, 384, 264, 374, 392

[56] References Cited

UNITED STATES PATENTS

| | | | |
|---|---|---|---|
| 2,011,217 | 8/1935 | Gebhardt | 141/48 |
| 2,623,672 | 12/1952 | O'Neil | 141/70 X |
| 3,779,292 | 12/1973 | Mencacci | 141/11 |
| 3,830,265 | 8/1974 | Matejek | 141/6 |

*Primary Examiner*—Richard E. Aegerter
*Assistant Examiner*—Frederick R. Schmidt
*Attorney, Agent, or Firm*—R. S. Kelly; C. E. Tripp

[57] ABSTRACT

A container filling apparatus includes a system for flushing air from a container during the filling of the container with a liquid such as a carbonated beverage. The filling apparatus includes a chamber having a filling valve at the lower end thereof which chamber is adapted to be filled with the beverage and lowered into the container before release of the beverage through the filling valve. A gas passage is associated with the chamber and is controlled so as to direct a volume of inert gas into the container prior to the opening of the filling valve to purge the air from within the container. During the actual filling of the container with the beverage, the gas passage is blocked; however, just prior to the termination of the filling cycle, the gas passage is opened to create a slight amount of foam at the surface of the beverage in the filled container and to place a layer of gas at the very top of the container to prevent the subsequent contamination of the beverage.

2 Claims, 9 Drawing Figures

FIG_6
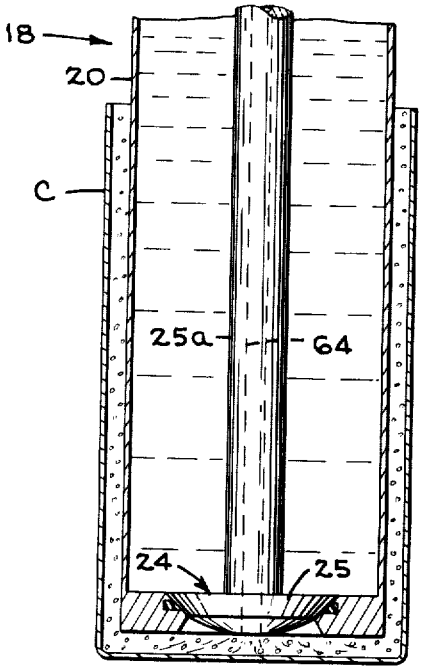
FIG_7
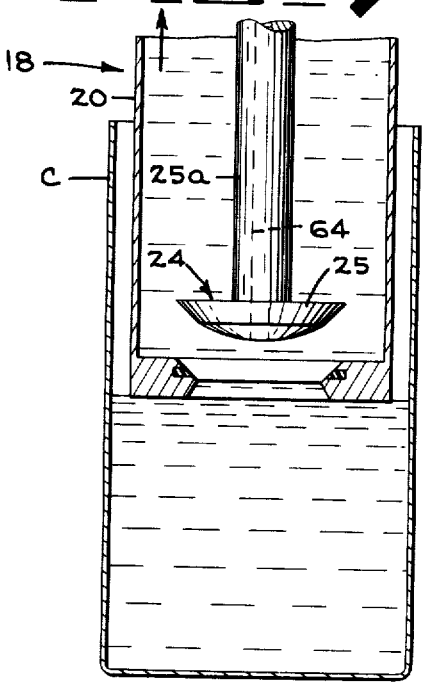
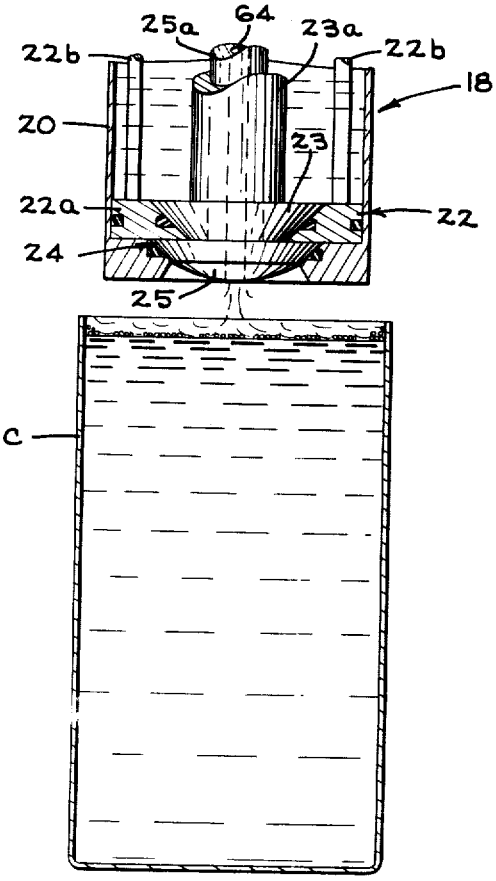
FIG_8
FIG_9
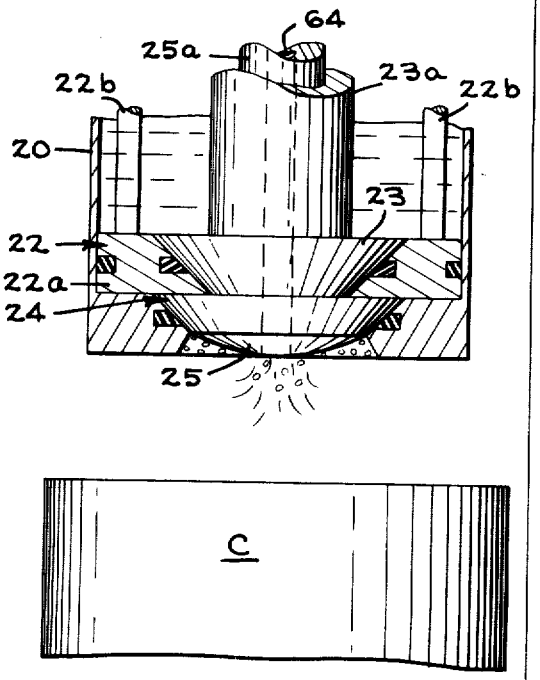

GAS FLUSHING SYSTEM FOR BEVERAGE FILLER

BACKGROUND OF THE INVENTION

1. Field of the Invention

This invention pertains to the beverage filling art and more particularly relates to a system for directing an inert gas into a container during the filling operation to purge substantially all of the air from the container and prevent the contamination of the beverage.

2. Description of the Prior Art

The desirability of removing air from filled containers and then filling the headspace with an inert gas prior to sealing to prevent oxidation of the product in the container is well known in the art. In my U.S. Pat. Nos. 3,236,023 and 3,443,352 methods are disclosed wherein product filled containers are placed in vacuum chambers so that air can be evacuated from the chamber and the headspace of the containers. An inert gas is thereafter directed into the vacuum chamber and headspace of the container, and the container is subsequently released from the chamber and sealed.

However, certain products, such as carbonated beverages, cannot be purged of air by vacuumization without a great loss of dissolved carbon dioxide in the beverage and, accordingly, a substantial reduction in quality.

Fillers for carbonated beverages, such as beer and soft drinks, are well known in the art, and the containers are usually filled while the containers are under a superatmospheric pressure of about 15–40 psi gauge. When filling carbonated beverages under superatmospheric pressure, the air within the container is usually discharged through a passage in the filling valve and into the superatmospheric headspace in the supply tank resulting in an undesirable mixture of air and carbon dioxide in the headspace of the tank. Also, pressure fillers of the above type were provided with snifter valves to bleed headspace air and carbon dioxide from the container headspace before the container was opened to the atmosphere.

My recently issued U.S. Pat. No. 3,779,292 discloses a beverage filling apparatus wherein a measuring cylinder having a filling valve at the lower end thereof is inserted into the container to be filled. When the measuring cylinder reaches near the bottom of the container, the volume of the cylinder is mechanically expanded slightly to reduce the pressure on the beverage, and then the filling valve is opened and the cylinder is moved upwardly relative to the container to allow the measured quantity of beverage in the cylinder to flow into the container.

When filling with a bottom opening filler of the type disclosed in the aforementioned U.S. Pat. No. 3,779,292, introduction of the filling cylinder into the open container displaces most of the air therefrom, and the subsequent opening of the cylinder and release of the beverage therein displaces the rest of the air therefrom to provide a beverage of high quality. However, it is recognized that small quantities of air remain in the container during the filling operation and come into contact with the beverage as it is being filled into the containers. It has also been recognized that such small quantities of air may become absorbed or entrained in the beverage itself so as to contaminate it.

SUMMARY OF THE INVENTION

The gas flushing system of the present invention is provided for use with a container filling apparatus of the bottom filling type in order to improve the quality of the beverage in the container by preventing the contact of the beverage with air during the filling operation.

In accordance with the present invention, a filling apparatus is provided wherein a beverage-filled chamber is lowered to the bottom of the container, and a filling valve at the lower end thereof is opened to allow the beverage to flow into the container. Just prior to the opening of the filling valve however, a gas passage, which is operatively associated with the chamber, is opened to allow a small amount of an inert gas to enter the container at or near the bottom thereof to purge the air therefrom. This gas passage is then closed prior to the opening of the filling valve. During the subsequent filling operation, the chamber is moved upwardly relative to the container to allow the beverage to flow evenly into the container but the surface level of the beverage in the container will be at all times insulated from the contaminating air by the previously injected inert gas.

At the end of the filling operation, it may be desirable to further protect the beverage within the container by injecting a small amount of air through the gas passage and into the beverage just before the filling valve clears the top surface of the liquid in order to cause a slight amount of foaming at the surface of the liquid. Also, any headspace in the container may be filled with the inert gas to further portect the beverage before the final closing and sealing of the container.

BRIEF DESCRIPTION OF THE DRAWINGS

FIG. 6 is an operational view of one of the filling heads illustrating the initial purging of a container with an inert gas just prior to the filling thereof.

FIG. 7 is an operational view similar to FIG. 6 but illustrating the position of the filling head during the filling of the beverage into the container.

FIG. 8 is an operational view similar to FIG. 6 but illustrating the filled container and the injection of inert gas into the container headspace.

FIG. 9 is an enlarged operational view similar to FIG. 8 and further illustrating the manner in which foam and drops of beverage are blown off the filling valve.

DESCRIPTION OF THE PREFERRED EMBODIMENT

Figure 1:
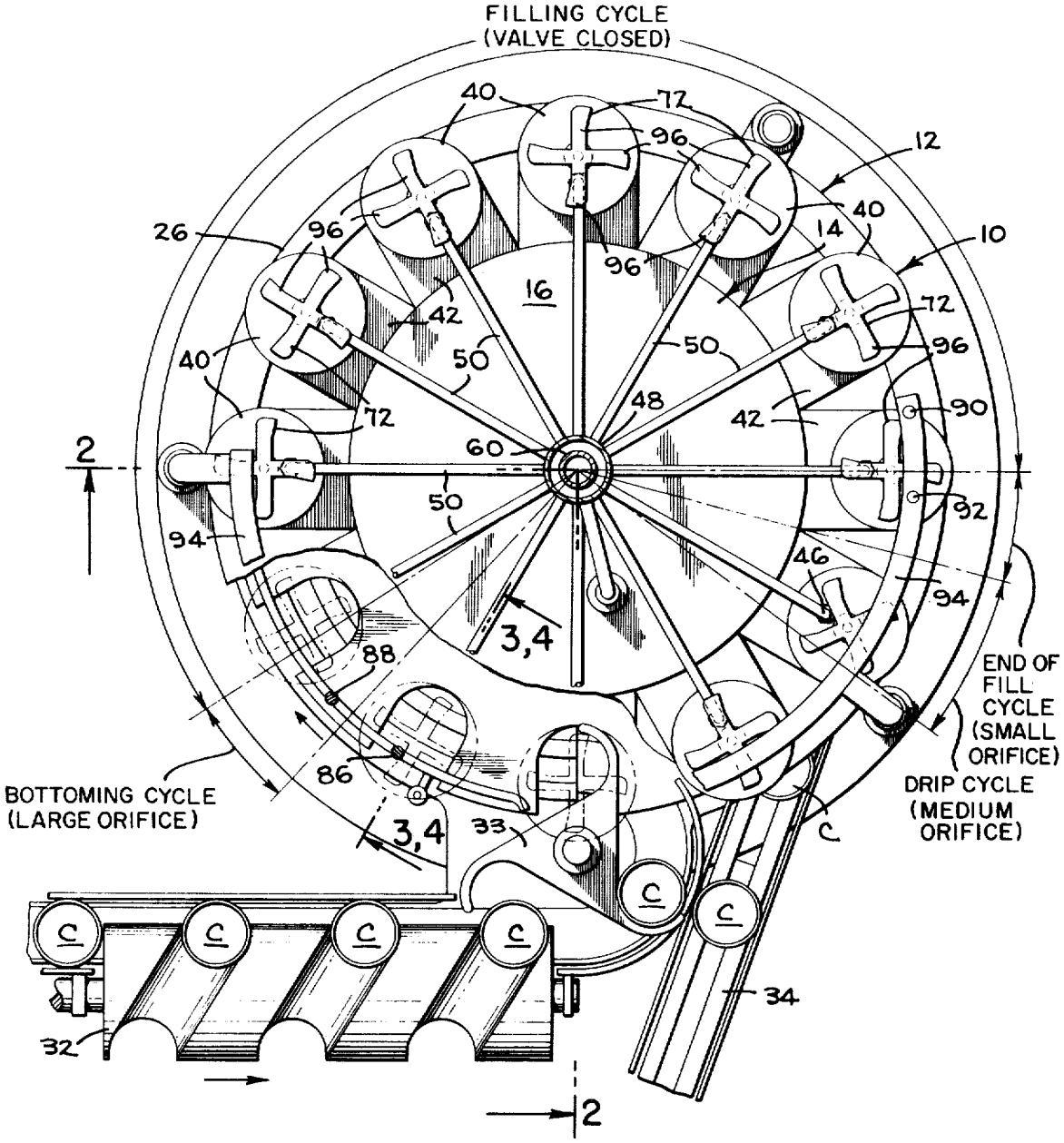
FIG. 1 is a diagrammatic plan of the flushing system and beverage filler of the present invention with certain parts thereof being broken away for the purpose of clarity.

The gas flushing system 10 (FIGS. 1 and 2) of the present invention is shown and described in connection with a beverage filler 12 of the type disclosed in my U.S. Pat. No. 3,779,292, and accordingly, the disclosure of this patent is specifically incorporated by reference herein for a further and more complete description of the structure and operation of the beverage filler.

In general, the beverage filler 12 (FIGS. 1, 2 and 3) comprises a rotatable turret 14 which includes a beverage supply tank 16 for holding a supply of a carbonated beverage, such as beer or a soft drink, under a superatmospheric pressure of between about 15–40 psi gauge. A plurality of vertically reciprocable filling heads 18 are carried by the turret 14 and communicate with the supply tank 16 through flexible conduits 19. Each filling head 18 (FIG. 1) includes a collapsible measuring chamber formed by a cylinder 20 which includes a relatively movable inlet valve 22 forming the upper end of the chamber and a foot valve 24 at the lower end of the chamber. The inlet valve 22 includes a valve plate 22*a* which is mounted in a fixed position on the turret 14 by means of support rods 22*b*, while the cylinder 20 is vertically movable relative thereto and is supported by a tube 20*a*. A valve plug 23 is fitted within the inlet valve plate and is supported for relative vertical movement by a support tube 23*a* slidably received within the tube 20*a*. The foot valve is opened and closed by means of a valve member 25 which is secured to a support tube 25*a* which is mounted for relative vertical movement within the tube 23*a*. Each of the support tubes 25*a*, 23*a* and 20*a* has attached thereto at its upper end a cam follower 27, 29 and 31, respectively, which are arranged to be received in cam tracks 26, 28 and 30, respectively. The cam tracks are shaped so as to move the measuring cylinder 20, the foot valve 24 and the inlet valve 22 in a manner, to be explained in greater detail hereinafter, wherein (1) the cylinder is lowered into a container C while being filled with the beverage between the foot valve and the inlet valve, (2) the foot valve is opened by relative upward movement of the valve member 25 to allow the beverage to flow into the container, and (3) the cylinder and foot valve are raised relative to the inlet valve 22 to cause all of the measured amount of beverage in the measuring chamber to be positively discharged. Upon subsequent lowering of the cylinder into the next container to be filled, the inlet valve 22 is opened by relative upward movement of the valve plug 23 to permit the recharging of the measuring chamber.

As the measuring cylinder 20 is moved into the container C, the inlet valve 22 is open and the foot valve 24 is closed thereby drawing a measured quantity of the pressurized liquid into the measuring chamber as determined by the distance the foot valve moves away from the inlet valve. When the cylinder 20 reaches the bottom of the container, both valves are closed to confine the measured quantity of pressurized liquid, and thereafter the measuring chamber is expanded several thousandths of an inch (by moving the cylinder downwardly relative to the closed inlet valve) thereby reducing the pressure of the measured quantity of liquid to atmospheric pressure. The foot valve is then opened and the associated portion of the measuring chamber 20 and foot valve are moved upwardly to the collapsed position as indicated at the right in FIG. 1 thus transferring the measured quantity of liquid at the atmospheric pressure into the container which has its upper end open to the atmosphere. The above described operation is then repeated for each container in turn all as fully described in my prior U.S. Pat. No. 3,779,292.

In order to perform the foregoing operations the turret 14 is arranged to be continuously rotated while the containers C are fed into position beneath the filling heads 18 by means of a feed screw 32 and star wheel 33 (FIG. 1). After being filled, the cans are arranged to be discharged from the turret by means of a discharge chute 34 (FIG. 1). The turret is arranged to be continuously driven by a drive train 36, shown in FIG. 2, which rotates a large gear 38 secured to the lower end of the tubular frame structure 39 that supports the turret.

The gas flushing system 10 is provided in the beverage filler 12 to more completely flush or purge air from the surfaces of the container and filling head which are contacted by the liquid by first directing a substantial quantity of an inert gas, such as carbon dioxide or nitrogen, into the container while the measuring cylinder 20 is moving into the container C and as it approaches the bottom of the container. For the purposes of this specification, the term "inert gas" shall mean any gas which is not chemically reactive with the liquid being filled. The gas flushing system is also used to reduce the foam on the surface of the liquid during filling and to reduce or eliminate the air entrapped in the liquid itself. A small amount of foam is created, however, just prior to the termination of the fill in order to better seal off the top surface of the liquid in the filled container. Finally, the gas flushing system is used to displace any air in the headspace of the filled container with an inert gas so that the container when thereafter sealed by conventional closing and sealing equipment will contain much less air or oxygen than was heretofore believed to be possible without resorting to vacuum filling techniques.

As diagrammatically shown in FIGS. 1–5, the flushing system 10 comprises a plurality of star wheel type gas valves 40, one valve for each filling head 18, that are mounted on a slotted flange 42 (FIG. 4) secured to and rotatable with the turret 14. Each valve 40 includes a housing 44 (FIGS. 4 and 5) with an inlet port that is connected by means of a fitting 46 to a radially extending conduit 50 having a pressure reducer (not shown) therein. Each of the radially extending conduits is connected with a vertically extending inert gas supply conduit 48 which is mounted concentric with the liquid supply conduit 60 as diagrammatically indicated in FIGS. 1 and 2. Both the liquid and gas supply conduits are connected to suitable supply sources by swivel joints or the like (not shown).

Figure 2:
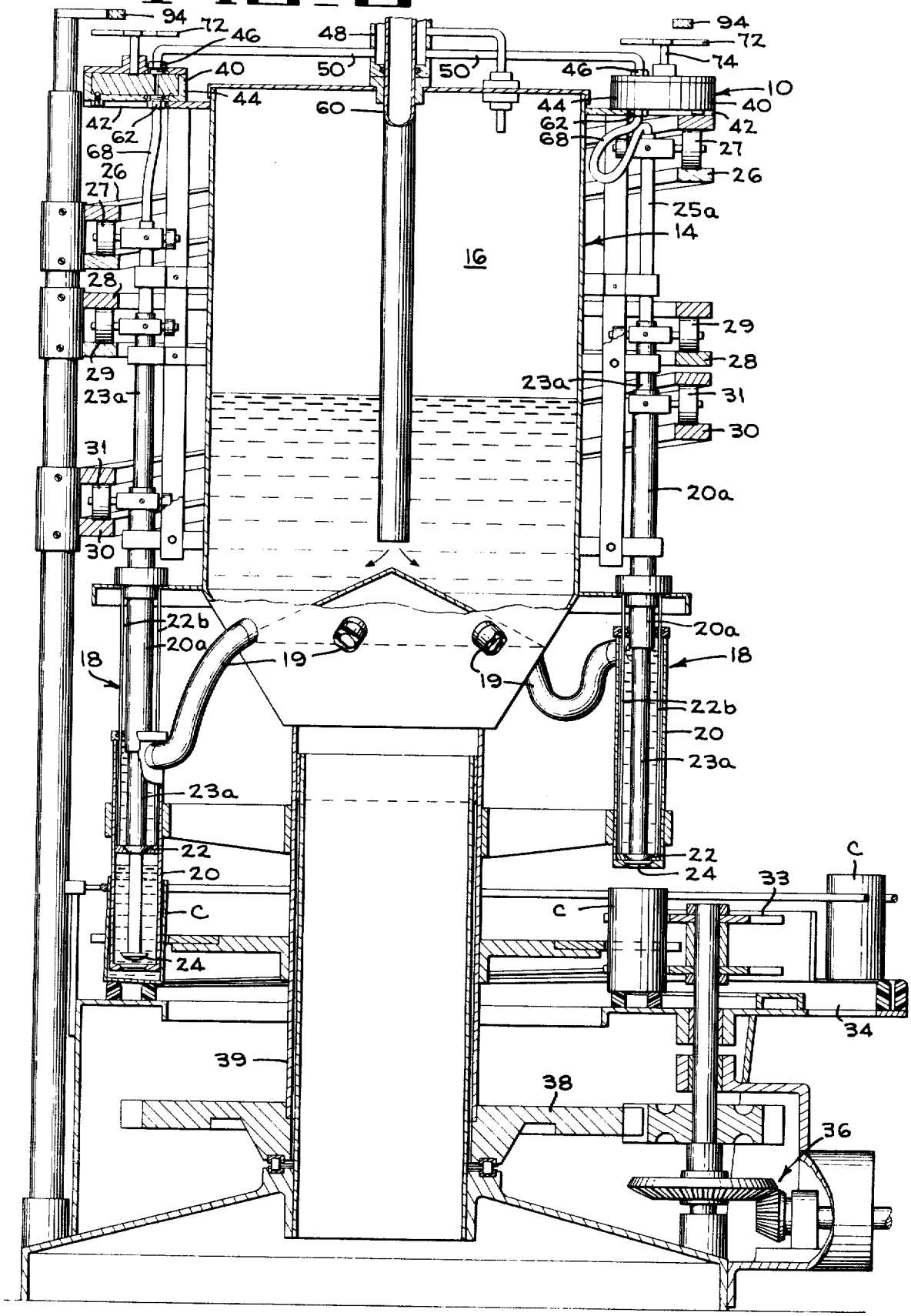
FIG. 2 is a vertical section taken along the line 2—2 of FIG. 1.
Figure 3:
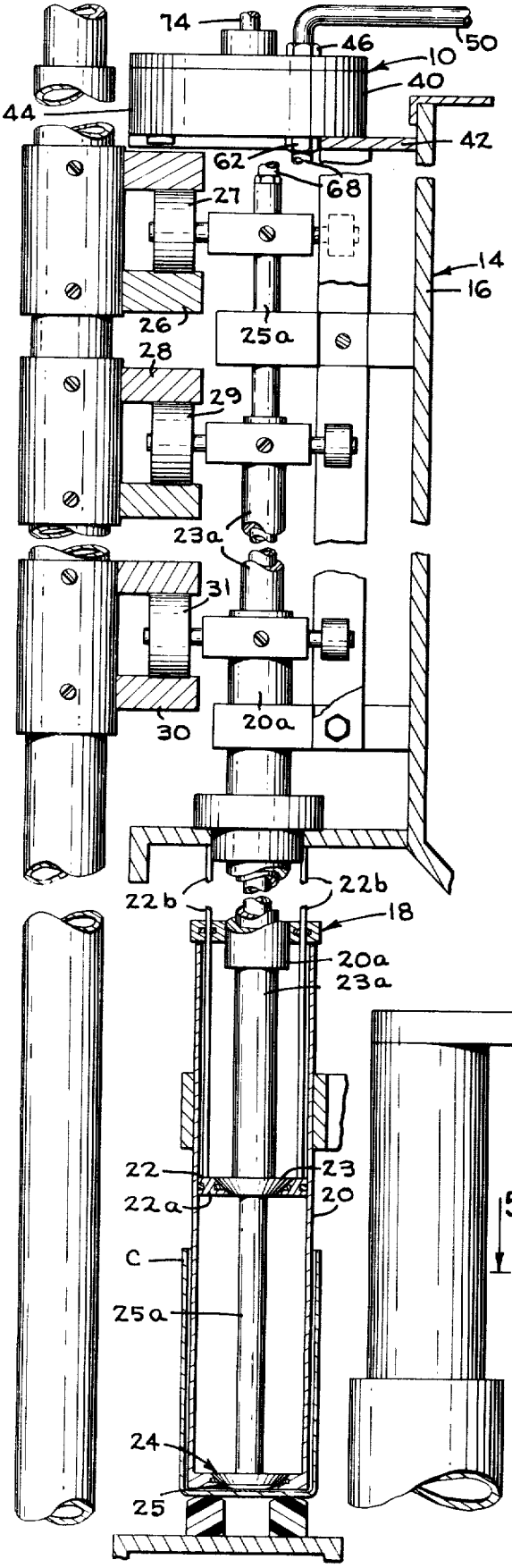
FIG. 3 is an enlarged diagrammatic section taken substantially along line 3—3 of FIG. 1 and illustrating one of the filling heads and its associated control structure.

Each valve housing 44 includes a discharge port which is connected by means of a fitting 62 (FIG. 4) to a flexible hose 68 which, in turn, communicates with a gas flow passage 64 in the support tube 25*a* for the valve member 25 of the foot valve in the associated filling head 18. As shown in FIGS. 2 and 3, the support tube 25*a* extends vertically to the uppermost portion of the filling head so that the hose 68 can be attached directly at the upper end thereof.

Figure 5:
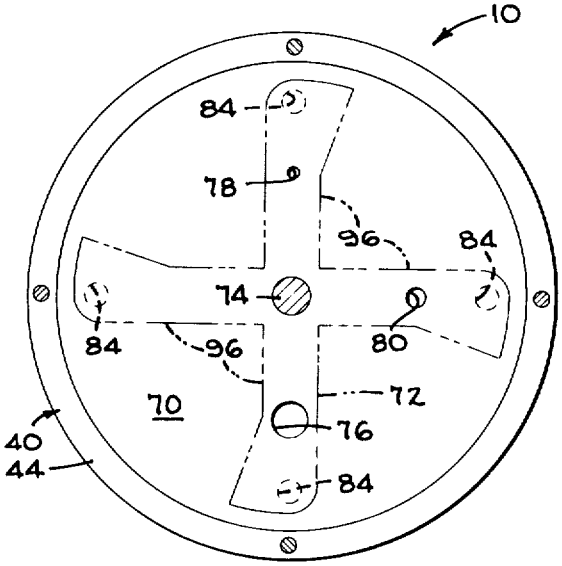
FIG. 5 is a horizontal section taken along line 5—5 of FIG. 4 with the superposed position of the star wheel actuator being shown in phantom lines.
Figure 4:
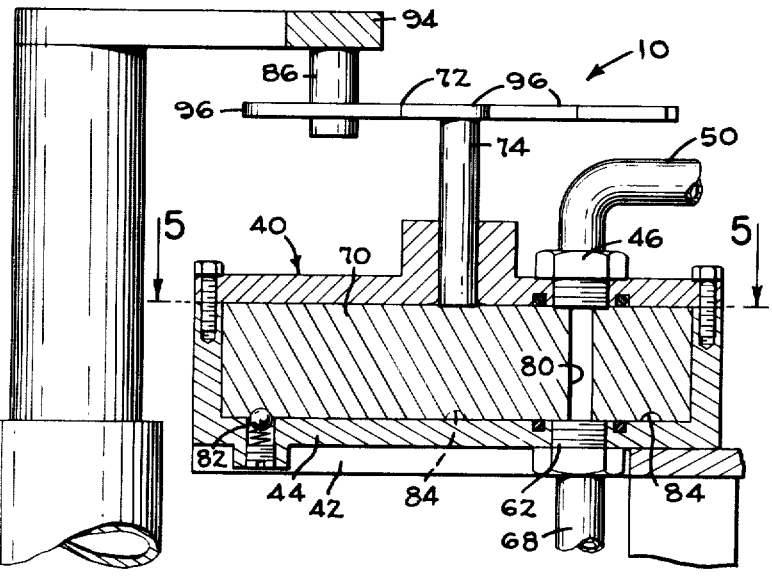
FIG. 4 is an enlarged vertical section taken along line 4—4 of FIG. 1 showing one of the gas flow control valves for directing an inert gas through the associated filling head.

As indicated in FIGS. 4 and 5, each gas valve 40 includes a rotatable core 70 within the housing 44 which is rotated in 90° increments by a star wheel 72 connected to the core by a shaft 74 that is journalled in the housing. In order to control the volume of gas passing through the valve from the inlet port fitting 46 through the discharge port fitting 62, a large orifice or passage 76, a small passage 78, and a medium sized passage 80 are provided in the core (FIG. 5). If desired, each passage 76, 78 and 80 may be provided with adjustable orifice restricting means (not shown) to more precisely regulate the volume of gas flow. A spring-loaded ball detent member 82 cooperates with four equally spaced indentations 84 in the valve core 70 to assure that the passages 76, 78 and 80 will be held in alignment with the inlet and discharge ports when the core is indexed.

Each valve core 70 is indexed into its four positions as the turret 14 is rotated by means of four abutment pins 86, 88, 90 and 92 (FIG. 2) which are secured to the underside of a stationary arcuate bracket 94 in a position to be engaged by the four fingers 96 of the star wheels 72 as the star wheels move therepast. As indicated in FIG. 1, the first abutment pin 86 will shift the associated vaalve core to a position wherein the large passage 76 registers with the inlet port fitting 46 and discharge port fitting 62 so that a high volume flow of inert gas is directed into the container as the measuring cylinder 20 is bottoming in the container C. This high volume flow of inert gas will flush the air out of the open upper end of a container C, including air which tends to cling to the inner surface of the container and the outer wetted surfaces of the foot valve and measuring cylinder—as illustrated in FIG. 6. Whether or not all of the air in the container is displaced by inert gas during this bottoming cycle is not critical since it is only important that a layer of inert gas be provided at the bottom of the container to thereafter insulate the beverage from the atmosphere during the filling of the container.

The second abutment pin 88 indexes the valve core 70 from the large passage position to the closed position thus prevents any inert gas from being directed into the liquid as it is being filled into the container during the filling cycle as illustrated in FIG. 1.

The third abutment pin 90 indexes the valve cores 70 from the closed position to a position where the inert gas flows through the small passage 78 in the core. This transmission of inert gas through the foot valve 24 takes place just prior to the termination of the filling as the foot valve is about to clear the surface of the liquid in the container. While this provision for injecting gas into the beverage at this time is an optional feature, it is believed that small amount of foam caused by such injection of inert gas will provide a better seal at the surface of the liquid to prevent subsequent contamination of the beverage by the atmosphere.

Finally, the fourth abutment pin 92, which is actuated almost immediately after the injection of inert gas through the small passage 78, indexes the valve cores from a position wherein the small passage 78 is in communication with the inert gas inlet and discharge ports to a position wherein the medium sized passage 80 is in communication with the inlet and discharge ports so as to provide for the injection a greater amount of inert gas to fill any headspace in the container. As indicated in FIG. 8, this transmission of inert gas takes place after the foot valve 24 has cleared the top surface of the liquid in the container. The filling of the headspace with inert gas provides a temporary seal to prevent the contamination of the beverage by the atmosphere prior to the sealing and closing of the container. During this drip cycle, any foam or liquid droplets which are on the lower surface of the valve member 25 adjacent to the orifice of the gas discharge passage 64 will be blown off by the gas flow into the underlying container—as shown in FIG. 9.

Thereafter, the filled container is transferred out of the filling apparatus along the discharge chute 34. While no means are shown for closing the gas flow passage 64 while the associated filling head moves from its position at the filled container discharge point to and through the empty container receiving point, it will normally be desirable to stop the flow of inert gas during this time period in order to prevent the undue loss of inert gas, and conventional valve means, which may be either mechanically or electrically controlled may be provided in the gas supply conduits 50 for this purpose. Such means should remain operative until the star wheel 72 is again indexed 90° by the first abutment pin 86 to rotate the associated valve core into a position wherein the large passage 76 is in communication with the gas inlet and outlet ports.

After the filled container is discharged along the discharge chute 34, it may be closed and sealed by a closing machine of any conventional type. A closing machine as disclosed in my prior U.S. Pat. No. 3,378,129, issued on Apr. 16, 1968, may be used for this purpose if desired.

From the foregoing description it will be apparent that the beverage filler and gas flushing system of the present invention provide a means whereby containers may be filled with a beverage and wherein an absolute minimum contact of the beverage with the atmosphere is obtained so as to prevent the contamination of the beverage prior to the closing and sealing of the containers.

Although the best mode contemplated for carrying out the present invention has been herein shown and described, it will be apparent that modification and variation may be made without departing from what is regarded to be the subject matter of the invention.

What is claimed is:

1. A method of filling a container with a liquid and flushing air from the container during the filling process to prevent the contamination of the liquid by the air, comprising the steps of: confining a quantity of liquid within a chamber, moving the chamber into the container to a position near the bottom thereof, releasing a quantity of inert gas into the container at the bottom thereof to cause said gas to flow upwardly to flush air therefrom, opening a filling valve at the bottom of the chamber to initially release the liquid into the container near the bottom thereof, moving the chamber out of the container while releasing the liquid into the container so as to purge therefrom through the upper end of the container the air and inert gas filling the container cavity, and directing a small amount of inert gas into the liquid just prior to the termination of the filling thereof into the container to create a small amount of foam at the liquid surface.

2. An apparatus for filling a liquid into a container comprising: a chamber for confining a quantity of liquid, a foot valve at the lower end of the chamber, means defining a gas flow passage through the chamber and foot valve, the passage having an exit on the bottom side of the foot valve so that gas exiting therefrom will not enter the chamber, means for moving the chamber into the container to a position wherein the foot valve is near the bottom thereof, means for directing a volume of inert gas into the container through said gas flow passage to flush air therefrom, means for opening the foot valve to initially release the liquid into the container near the bottom thereof, means for moving the chamber out of the container while releasing the liquid into the container, and control means, operatively associated with said foot valve opening means, for controlling the flow of inert gas through said gas flow passage so that said volume of said inert gas is directed into the container when said chamber is near the bottom thereof and so that said flow is terminated prior to the opening of said foot valve, said control means further including means for initiating the flow of a relatively small amount of inert gas into the liquid through said gas flow passage just prior to the termination of said filling in order to create a small amount of foam at the liquid surface after filling.

* * * * *